US007540499B2

(12) United States Patent
Webb

(10) Patent No.: US 7,540,499 B2
(45) Date of Patent: Jun. 2, 2009

(54) POKER GAMES WITH VARYING POSITION ADVANTAGE

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 320 days.

(21) Appl. No.: 11/227,106

(22) Filed: Sep. 16, 2005

(65) Prior Publication Data

US 2007/0063439 A1 Mar. 22, 2007

(51) Int. Cl.
*A63F 1/00* (2006.01)
*A63F 9/20* (2006.01)

(52) U.S. Cl. ..... 273/292; 273/293; 273/274; 463/13

(58) Field of Classification Search ..... 273/292
See application file for complete search history.

(56) References Cited

U.S. PATENT DOCUMENTS 5,423,551 A * 6/1995 Stavinsky ..... 273/306
5,489,101 A 2/1996 Moody
5,531,448 A 7/1996 Moody
5,607,161 A * 3/1997 Skratulia ..... 273/292
5,718,430 A 2/1998 Aramapakul et al.
5,810,354 A 9/1998 Banyai
5,868,392 A 2/1999 Kraft
5,951,011 A 9/1999 Potter et al.
6,132,311 A 10/2000 Williams
6,206,373 B1 3/2001 Garrod
6,299,170 B1 10/2001 Yoseloff
6,325,375 B1 12/2001 Potter et al.
6,332,614 B1 * 12/2001 Hesse ..... 273/292
6,386,973 B1 5/2002 Yoseloff
6,517,072 B1 2/2003 McInerney
6,554,281 B2 * 4/2003 Flannery ..... 273/274
6,637,747 B1 10/2003 Garrod

OTHER PUBLICATIONS

John Scarne, "Scarne's Encylopedia of Card Games", Harper and Row 1973, pp. 14 and 26.*

* cited by examiner

*Primary Examiner*—Gene Kim
*Assistant Examiner*—Michael D Dennis
(74) *Attorney, Agent, or Firm*—Nixon & Vanderhye P.C.

(57) ABSTRACT

A card game among a plurality of players is played by dealing hands of cards to the players one card at a time, conducting an initial round of wagering among the players, and conducting subsequent rounds of wagering among the players. At least one of the subsequent rounds of wagering among the players being conducted in a second direction opposite from the first direction. By varying the wagering round direction over the course of a hand, a button player advantage can be reduced.

26 Claims, 2 Drawing Sheets

POKER GAMES WITH VARYING POSITION ADVANTAGE

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

Texas Hold 'Em has become popular over the last several years due to its simplicity, the ability to accommodate a higher number of players per table, internet and tournament poker as well as televised poker. The game is played so that each player has the use of seven cards in order to form a five card poker hand. The player having the highest poker hand is the game winner. Hands are ranked in standard poker fashion, i.e. royal flush, straight flush, four of a kind, full house, flush, straight, three of a kind, two pair, one pair, and high card, in descending order.

In Texas Hold Em, each player receives two cards face down. Additionally, there are five community cards dealt face up. The term "community card" refers to a non-player specific card that is exposed (face up) and available for use by any of the players in order to form a poker hand. Each player is enabled to use seven cards (i.e. the two concealed cards held by the player, plus the five community cards that are available to each player).

In Texas Hold Em, the cards are dealt sequentially so that each player initially receives two cards face down, after which the five community cards are dealt face up. Rounds of betting occur at certain times during the course of the deal, usually after the two face down cards have been dealt, then after the third community card has been dealt (dealt three cards at one time, called the "flop"), then after the fourth community card has been dealt (the "turn"), and finally after the fifth community card has been dealt (the "river"). Thus, there are four rounds of betting, where antes and/or blinds prior to the cards being dealt are considered part of the first round.

When game rules include an ante, all players are required to put a certain fixed amount into the "pot" in order to participate in the hand. In this instance, in a typical game, the player making the first wager is the player sitting in next clockwise sequence of a button player. A blind is also a wager that is required prior to dealing any cards, but in a typical game, the two players sitting in next clockwise sequence of the button player are required to place a "blind" wager, sometimes in unequal amounts. For example, the player sitting to the immediate clockwise sequence of the button player may be considered the small blind with a first required wager amount, and the next player in clockwise sequence may be considered the big blind with a second larger required amount (typically twice the small blind amount). The usual structure is to use two blinds, but it is possible to play the game with one blind, multiple blinds, an ante, or combination of blinds plus an ante. In a two blind game, after the player cards are dealt, the player sitting in next clockwise sequence of the big blind player would make the next wager (the "first" wagers of the first wagering round being made as small blind and big blind).

Omaha is another popular poker game utilizing community cards. In Omaha, each player is dealt four face down cards (personal cards), after which a first round of betting is conducted. The dealer then deals three community cards (the "flop"), and a second wagering round is conducted. The dealer then deals a fourth community card (the "turn"), and a third round of betting is conducted. Finally, the dealer then deals a fifth community card (the "river"), and a final betting round is conducted. In a fast-action version of Omaha, the turn card and the river card are dealt together so that only three rounds of betting are conducted.

At the showdown, each player must use exactly two of their personal cards and three of the five community cards. In a HIGH-LOW game, each player can use any two personal cards for a high hand and any two pocket cards for a low hand. Typically, a best low hand is A-2-3-4-5, which may also count as a straight to be the best high hand. Straights and flushes are not considered for counting a low hand.

As is typical in poker games using community cards, a marker or "button" is used as an indicator for beginning a round of wagering, usually by the first player sitting in next clockwise sequence of the player holding the button (the button player) who is still in the game. The button is passed clockwise one player after each hand is completed. There is an inherent advantage to the button player as the button player is afforded the opportunity to see each player's wager action prior to acting. The button player can thus gain a sense about each player's hand before deciding what action to take (wager, call, raise or fold). The button player is always the last player to act until such time as the button player folds, whereby the player acting immediately prior to the button player becomes the last player to act.

BRIEF SUMMARY OF THE INVENTION

As a variant to conventional poker games, particularly those utilizing community cards, the present invention encompasses poker games where the betting order or direction varies during wagering rounds of one hand. For example, a first wagering round may proceed in the conventional manner described above, and a second or subsequent wagering round may start with a different player and/or proceed in an opposite direction (counter-clockwise or "anti-clockwise") among the players. The varied wagering order can be changed for each betting round or follow a preset pattern. In this manner, the button player does not have the advantage during the entire hand. As mentioned above, this advantage is significant during conventional play as the button player in the conventional game has the ability to use wager action to influence the game. That is, in each wagering round in the conventional game, the button player is afforded the opportunity to see each player's wager action prior to acting. The button player can thus gain a sense about each player's hand before deciding what action to take (wager, call, raise or fold). Eliminating or reducing this advantage by the method of the present invention distributes the advantage during the game, resulting in a game methodology that is more fair than the conventional methodology.

In an exemplary embodiment of the invention, a method of playing a card game includes the steps of (a) establishing a button player among a plurality of players; (b) dealing cards beginning with a starting player positioned relative to the button player, the starting player being a player still in the game sitting in next clockwise sequence of the button player; (c) conducting an initial round of wagering beginning with one of (1) a last acting player, who is either the button player or a player still in the game sitting in next anti-clockwise sequence of the button player if the button player is no longer in the game, or (2) the starting player; (d) dealing at least one community card; (e) conducting a subsequent round of wagering beginning with the other of (1) the last acting player, or (2) the starting player; and (f) completing the card game according to game rules.

The card game preferably includes multiple subsequent rounds of wagering, where step (e) is practiced by alternating the beginning wager between the last acting player and the starting player. In one embodiment, the card game includes four rounds of wagering, where steps (c) and (e) are practiced with the initial round of wagering beginning with the starting player, with two subsequent rounds of wagering beginning with the last acting player, and with the last subsequent round of wagering beginning with the starting player.

The card game is preferably poker and each played hand comprises a complete game, where steps (a)-(f) are practiced for each played hand. The game may be Texas Hold 'Em, Omaha or any other suitable variation.

The method may additionally include, after step (a), a step of placing a button marker in a player area of the button player. The button marker may be provided with at least one indicator that illustrates a direction in which an impending wagering round is conducted, or possibly a plurality of indicators each corresponding to one of a plurality of wagering rounds.

In another exemplary embodiment of the invention, a method of playing a card game with a plurality of players includes the steps of dealing hands of cards to the players one card at a time; conducting an initial round of wagering among the players in a first direction; and conducting subsequent rounds of wagering among the players, at least one of the subsequent rounds of wagering among the players being conducted in a second direction opposite from the first direction. The method may additionally include dealing at least one community card between the initial round of wagering and the subsequent rounds of wagering and/or dealing at least one additional community card between the subsequent rounds of wagering.

Preferably, the first direction is a clockwise direction, and the second direction is a anti-clockwise direction. In this context, in one operating mode, with the initial round of wagering being started with a starting player, at least the starting player begins wagering in the initial round of wagering with a fixed wager placed prior to dealing hands of cards to the players. Additionally, the starting player and a player sitting clockwise in sequence of the starting player may begin wagering in the initial round of wagering with fixed wagers placed prior to dealing hands of cards to the players. The fixed wager for the starting player is preferably different from the fixed wager for the player clockwise in sequence of the starting player.

In yet another exemplary embodiment of the invention, a button marker is provided for use with the method of the invention, the button marker including an indicator that illustrates a direction in which an impending wagering round is conducted. The button marker may include a plurality of indicators each corresponding to one of a plurality of wagering rounds.

BRIEF DESCRIPTION OF THE DRAWINGS

These and other aspects and advantages of the present invention will be described in detail with reference to the accompanying drawing, in which.

DETAILED DESCRIPTION OF THE INVENTION

Figure 1:
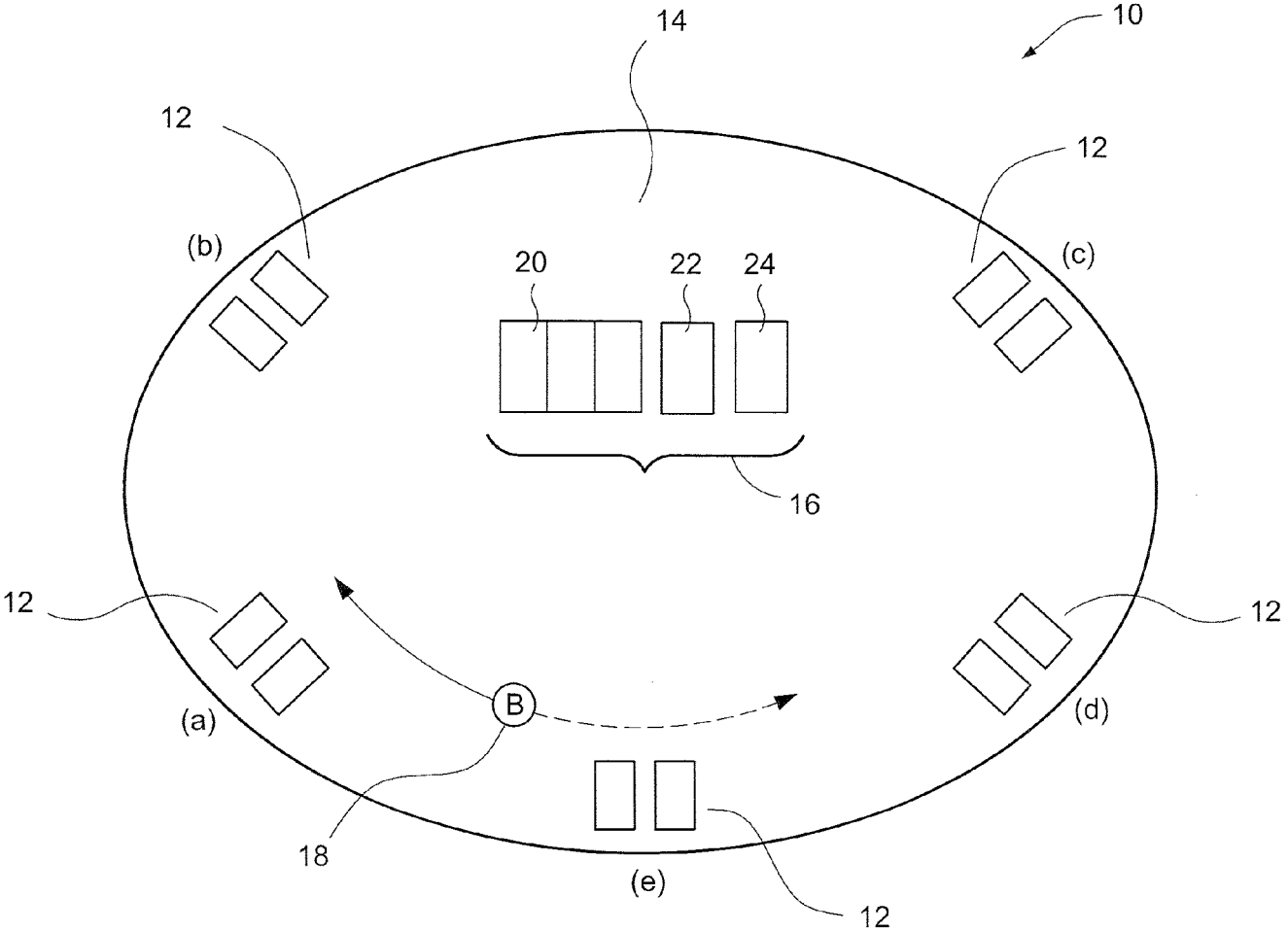
FIG. 1 is an exemplary game play scenario illustrating the method of the present invention.

FIG. 1 is an exemplary illustration of a game play scenario for a Texas Hold 'Em poker game. Although in the exemplary embodiment illustrated in FIG. 1, the method of the invention is illustrated in the context of an application to Texas Hold 'Em, the concept of the invention may be suitable for various poker games, particularly those including community cards such as Omaha and others.

The table 10 is shown with five player areas 12 for players (a)-(e), although many players or fewer players can play at one time. In a casino environment, a dealer typically sits in a dealer area 14 and deals cards to each player as well as community cards 16.

In a typical Hold 'Em poker game, a button player is first established among the plurality of players. A button marker 18 may be provided on the table to indicate which player is the button player. In the exemplary illustration in FIG. 1, the button player is player (e). When dealing cards, the dealer deals the first card to the player sitting next to the button player in a clockwise direction around the table (player (a)). In Texas Hold 'Em, each player receives a first card beginning with the player sitting in next clockwise sequence of the button player (player (a)), and then each player receives a second card in order. A wagering round is then conducted beginning with the first player sitting next to the button player in the clockwise direction who is still in the game. If the game is being played as a two-blind game, the player sitting in next clockwise sequence of the button player (player (a)) is the small blind and wagers a first amount, and the player in next clockwise sequence of the small blind (player (b)) is the big blind and wagers a second amount, typically twice the first amount. These wagers are considered part of the first wagering round, so the first player to wager after the cards are dealt would be the player in clockwise sequence of the big blind (player (c)).

After the first round of wagering is concluded, the dealer deals a first set of three community cards 20, called the "flop." A second round of wagering is conducted typically beginning with the first player in clockwise sequence of the button player who is still in the game and proceeding clockwise around the table. When the second round of wagering is completed, the dealer deals another community card 22, called the "turn." After yet another round of wagering also beginning with the first player sitting next to the button player in the clockwise direction who is still in the game, the dealer deals a fifth community card 24, called the "river." A final wagering round is then conducted again beginning with the first player sitting next to the button player in the clockwise direction who is still in the game.

After the wagering rounds are completed, player hands for players still in the game are compared, and the best player hand wins the pot. After the played hand is complete, the button 18 typically passes to the next player at the table in the clockwise direction (player (a) in FIG. 1), and play begins again. See the solid arrow in FIG. 1.

With the conventional methodology, the button player or last acting player has a distinct advantage over the other players in that the last acting player has a positional advantage on each betting round throughout the entire hand (provided the button player stays in the game). As such, the button player can better assess each player's actions and mannerisms before deciding whether to wager or fold etc. This advantage is significant during conventional play as the last acting player in the conventional game has the ability to use wager action to influence the game. That is, in each wagering round in the conventional game, the last acting player is afforded the opportunity to see each player's wager action prior to making a wager. The last acting player can thus gain a sense about each player's hand before deciding what action to take (wager, call, raise or fold). Eliminating or reducing this positional advantage by the method of the present invention distributes the advantage during the game, resulting in a game methodology that is more fair than the conventional methodology.

In order to reduce the positional advantage, the poker method according to the present invention varies the wagering order or direction. The direction around the table for player wagers may be reversed on a round-by-round basis or for first and last wagering rounds, second and third wagering rounds or any other combination. See the dashed arrow in FIG. 1.

In one embodiment, the beginning wagers on each round alternate between the first player still in the game sitting in clockwise sequence of the button player ("the starting player") and either the button player or the first player still in the game sitting in anti-clockwise sequence of the button player if the button player is no longer in the game ("the last acting player"). In these alternating rounds, the wagering direction may follow clockwise, anti-clockwise, clockwise, anti-clockwise or vice versa beginning with anti-clockwise. Alternatively, with a card game including four rounds of wagering, the wagering rounds may be practiced with the initial round of wagering beginning with the starting player with subsequent rounds of wagering beginning with the last acting player in the opposite direction, and with the last subsequent round of wagering beginning with the starting player. In this context, the wagering direction may follow clockwise, anti-clockwise, anti-clockwise, clockwise, or the opposite as anti-clockwise, clockwise, clockwise, anti-clockwise. Still further, the wagering rounds may follow clockwise, clockwise, anti-clockwise, anti-clockwise, or the opposite as anti-clockwise, anti-clockwise, clockwise, clockwise.

In a two blind game, prior to any cards being dealt, the player sitting next to the button player in clockwise sequence (player (a) in FIG. 1) makes an initial wager for the first round of wagering as the small blind, and the player sitting in clockwise sequence next to the small blind (player (b) in FIG. 1) makes an initial wager as the big blind. After the first cards are dealt to the players, the next wager decision is made (call, raise or fold) by the player sitting next to the big blind in the clockwise direction (player (c) in FIG. 1). In describing this concept, it is assumed that the blinds form part of the first round of wagering. Moreover, when there are two players only, if the first player has the big blind then the button is first to act on the first round only. Of course, there is no clockwise or anti-clockwise wagering with only two players in the game; rather it is a question of who makes the first wager.

Other possibilities for games utilizing four wagering rounds include, for example, (1) R1—clockwise, R2—clockwise, R3—anti-clockwise, and R4—anti-clockwise, (2) R1—anti-clockwise, R2—anti-clockwise, R3—clockwise, and R4—clockwise; (3) R1—anti-clockwise, R2—clockwise, R3—clockwise, and R4—anti-clockwise; (4) R1—anti-clockwise, R2—clockwise, R3—anti-clockwise, and R4—clockwise; (5) R1—clockwise, R2—clockwise, R3—clockwise, and R4—anti-clockwise; (6) R1—anti-clockwise, R2—clockwise, R3—clockwise, and R4—clockwise; (7) R1—anti-clockwise, R2—anti-clockwise, R3—anti-clockwise, and R4—clockwise; and (8) R1—clockwise, R2—anti-clockwise, R3—anti-clockwise, and R4—anti-clockwise. In these scenarios, it is assumed that a clockwise wagering round begins with the starting player (as defined above—even if the beginning wager for the first round is a blind) and that a anti-clockwise wagering round beings with the last acting player (as defined above).

In a game with three rounds of wagering, such as fast action Omaha, wagering order may be practiced as any one of: (1) R1—clockwise, R2—anti-clockwise, and R3—anti-clockwise; (2) R1—anti-clockwise, R2—anti-clockwise, and R3—clockwise; (3) R1—clockwise, R2—clockwise, and R3—anti-clockwise; (4) R1—anti-clockwise, R2—clockwise, and R3—clockwise; (5) R1—clockwise, R2—anti-clockwise, and R3—clockwise; and (6) R1—anti-clockwise, R2—clockwise, and R3—anti-clockwise.

Figure 2:
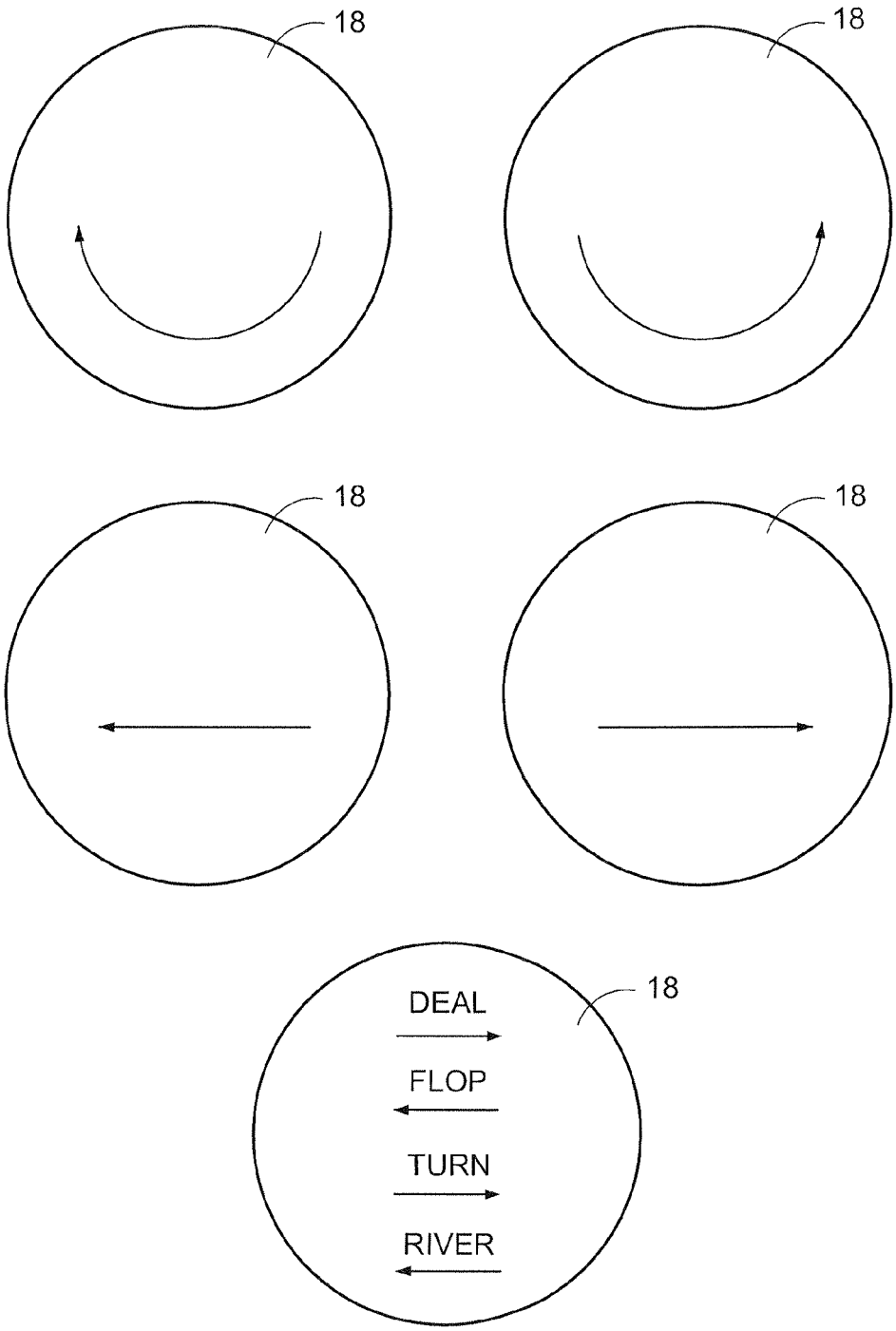
FIG. 2 shows exemplary dealer buttons for use during game play.

To ensure that all players understand the wagering order, the button marker 18 may be marked with the wagering directions as shown in FIG. 2. With the single arrow marker, prior to each wagering round, the dealer can orient the button marker 18 so that the arrow points in the direction of wagering around the table. Alternatively, each button marker may be provided with multiple arrows to indicate wagering directions for each phase of a hand. The markings shown in FIG. 2 are exemplary, and the invention is not meant to be limited to the illustrated examples. The table may alternatively include markings or lights or the like designating the button player and wagering direction.

As would be apparent to those skilled in the relevant art, the embodiments described above can be embodied in a wide variety of forms and media including, but not limited to, single player slot video machines, multi-player slot video machines, electronic games and devices, lottery terminals, scratch-card formats, software as well as in-flight, home and internet entertainment. In addition, the described embodiments can also be readily implemented as a computer program product (e.g., floppy disks, compact disks, etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a player(s) versus player(s) card game comprising:

(a) using at least one device or using a table, initiating a hand with multiple rounds of wagering by establishing a button player among a plurality of players, the hand being resolved only after completing the multiple rounds of wagering;

(b) dealing cards beginning with a starting player positioned relative to the button player, the starting player being a player still in the hand sitting in next clockwise sequence of the button player;

(c) conducting an initial round of wagering in one direction beginning with one of (1) a last acting player, who is either the button player or a player still in the hand sitting in next anti-clockwise sequence of the button player if the button player is no longer in the hand, or (2) the starting player, wherein the one direction and the one of (1) the last acting player or (2) the starting player are pre-established prior to step (c);

(d) dealing at least one community card;

(e) conducting a subsequent round of wagering in the hand in an opposite direction beginning with the other of (1) the last acting player, or (2) the starting player; and (f) completing the hand according to game rules.

2. A method according to claim 1, wherein the hand includes multiple subsequent rounds of wagering, and wherein step (e) is practiced by alternating the beginning wager between the last acting player and the starting player.

3. A method according to claim 1, wherein the hand includes four rounds of wagering, and wherein steps (c) and (e) are practiced with the initial round of wagering beginning with the starting player, with two subsequent rounds of wagering beginning with the last acting player, and with the last subsequent round of wagering beginning with the starting player.

4. A method according to claim 1, wherein the card game is poker and each hand comprises a complete game.

5. A method according to claim 1, wherein the card game is Texas Hold 'Em.

6. A method according to claim 1, wherein the card game is Omaha.

7. A method according to claim 1, further comprising, after step (a), placing a button marker in a player area of the button player.

8. A method according to claim 7, further comprising providing the button marker with at least one indicator that illustrates a direction in which an impending wagering round is conducted.

9. A method according to claim 8, wherein the providing step comprises providing the button marker with a plurality of indicators each corresponding to one of a plurality of wagering rounds.

10. A method of playing a player(s) versus player(s) card game with a plurality of players, the method comprising dealing hands of cards to the players one card at a time using at least one device or using a table; conducting an initial round of wagering among the players in a first direction; conducting subsequent rounds of wagering among the players, at least one of the subsequent rounds of wagering among the players being conducted in a second direction opposite from the first direction; and resolving the card game and wagers only after completing all rounds of wagering, wherein the first direction is pre-established prior to conducting the initial round of wagering.

11. A method according to claim 10, further comprising dealing at least one community card between the initial round of wagering and the subsequent rounds of wagering.

12. A method according to claim 11, further comprising dealing at least one additional community card between the subsequent rounds of wagering.

13. A method according to claim 10, wherein the first direction is a clockwise direction.

14. A method according to claim 13, wherein the second direction is a anti-clockwise direction.

15. A method according to claim 14, wherein the initial round of wagering is started with a starting player, and wherein at least the starting player begins wagering in the initial round of wagering with a fixed wager placed prior to dealing hands of cards to the players.

16. A method according to claim 15, wherein the starting player and a player sitting clockwise in sequence of the starting player begin wagering in the initial round of wagering with fixed wagers placed prior to dealing hands of cards to the players.

17. A method according to claim 16, wherein the fixed wager for the starting player is different from the fixed wager for the player clockwise in sequence of the starting player.

18. A method according to claim 10, wherein the card game includes four rounds of wagering (R1-R4), and wherein the wagering rounds are conducted according to one of: (1) R1—clockwise, R2—clockwise, R3—anti-clockwise, and R4—anti-clockwise, (2) R1—anti-clockwise, R2—anti-clockwise, R3—clockwise, and R4—clockwise; (3) R1—anti-clockwise, R2—clockwise, R3—clockwise, and R4—anti-clockwise; (4) R1—anti-clockwise, R2—clockwise, R3—anti-clockwise, and R4—clockwise; (5) R1—clockwise, R2—clockwise, R3—clockwise, and R4—anti-clockwise; (6) R1—anti-clockwise, R2—clockwise, R3—clockwise, and R4—clockwise; (7) R1—anti-clockwise, R2—anti-clockwise, R3—anti-clockwise, and R4—clockwise; (8) R1—clockwise, R2—anti-clockwise, R3—anti-clockwise, and R4—anti-clockwise; (9) R1—clockwise, R2—anti-clockwise, R3—clockwise, and R4—anti-clockwise; (10) R1—anti-clockwise, R2—anti-clockwise, R3—clockwise, and R4—anti-clockwise; (11) R1—clockwise, R2—anti-clockwise, R3—anti-clockwise, and R4—clockwise; (12) R1—anti-clockwise, R2—clockwise, R3—anti-clockwise, and R4—anti-clockwise; (13) R1—clockwise, R2—clockwise, R3—anti-clockwise, and R4—clockwise; and (14) R1—clockwise, R2 —anti-clockwise, R3—clockwise, and R4—clockwise.

19. A method according to claim 18, wherein the initial round of wagering is started with a starting player, the starting player being a player still in the game sitting in next clockwise sequence of a button player established prior to beginning the card game, and wherein clockwise rounds begin with the starting player even if the starting player wager is at least one of mandatory and placed prior to dealing hands of cards to the players.

20. A method according to claim 10, wherein the card game includes three rounds of wagering (R1-R3), and wherein the wagering rounds are conducted according to one of: (1) R1—clockwise, R2—anti-clockwise, and R3—anti-clockwise; (2) R1—anti-clockwise, R2—anti-clockwise, and R3—clockwise; (3) R1—clockwise, R2—clockwise, and R3—anti-clockwise; (4) R1—anti-clockwise, R2—clockwise, and R3—clockwise; (5) R1—clockwise, R2 —anti-clockwise, and R3—clockwise; and (6) R1—anti-clockwise, R2—clockwise, and R3—anti-clockwise.

21. A method according to claim 10, wherein the card game is Texas Hold 'Em.

22. A method according to claim 10, wherein the card game is Omaha.

23. A button marker for use with the method of claim 10, the button marker comprising an indicator that illustrates a direction in which an impending wagering round is conducted.

24. A button marker according to claim 23, wherein the button marker comprises a plurality of indicators each corresponding to one of a plurality of wagering rounds.

25. A method of playing a player(s) versus player(s) card game comprising:

(a) using at least one device or using a table, initiating a hand with multiple rounds of wagering by establishing a button player among a plurality of players, the hand being resolved only after completing the multiple rounds of wagering;

(b) dealing hands of cards to the players;

(c) conducting an initial round of wagering in one direction beginning with one of (1) a last acting player, who is either the button player or a player still in the hand sitting in next anti-clockwise sequence of the button player if the button player is no longer in the hand, or (2) a starting player, who is a player still in the hand sitting in next clockwise sequence of the button player, wherein the one direction and the one of (1) the last acting player or (2) the starting player are pre-established prior to step (c);

(d) dealing at least one community card;

(e) conducting a subsequent round of wagering in the hand in an opposite direction beginning with the other of (1) the last acting player, or (2) the starting player; and (f) completing the hand according to game rules.

26. A method of playing a player(s) versus player(s) card game with a plurality of players, the method comprising dealing hands of cards to the players using at least one device or using a table; conducting an initial round of wagering among the players in a first direction; conducting subsequent rounds of wagering among the players, at least one of the subsequent rounds of wagering among the players being conducted in a second direction opposite from the first direction; and resolving the card game and wagers only after completing all rounds of wagering, wherein the first direction is pre-established prior to conducting the initial round of wagering.

* * * * *